United States Patent [19]

Snyder

[11] Patent Number: 4,534,202

[45] Date of Patent: Aug. 13, 1985

[54] CUP FEEDING MECHANISM

[75] Inventor: Walter W. Snyder, Joshua, Tex.

[73] Assignee: National Can Corporation, Chicago, Ill.

[21] Appl. No.: 518,917

[22] Filed: Aug. 25, 1983

Related U.S. Application Data

[63] Continuation of Ser. No. 180,325, Aug. 22, 1980, abandoned.

[51] Int. Cl.[3] ..... B21D 22/00

[52] U.S. Cl. ..... 72/349; 72/424; 72/428

[58] Field of Search ..... 72/347, 348, 349, 419, 72/424, 428

[56] References Cited

U.S. PATENT DOCUMENTS 3,491,575 1/1970 Prendergast ..... 72/349

4,061,012 12/1977 Wessman ..... 72/424

*Primary Examiner*—Leon Gilden

*Attorney, Agent, or Firm*—Robert A. Stenzel; Ralph R. Rath

[57] ABSTRACT

A cup feeding mechanism for a bodymaker includes a guide chute defining a vertical path with a stop located at the lower end of the path defining a transfer area. The stop has a specifically configured area for receiving each cup and defining a fixed position for the cup in the transfer area. A drive member is reciprocated transversely of the path and picks up cups from the transfer area and positively drives them into alignment with a ram that extends perpendicular to the axis of the path so that the cups are maintained in accurate alignment with the ram prior to being transferred through the bodymaker.

10 Claims, 3 Drawing Figures

CUP FEEDING MECHANISM

REFERENCE TO RELATED APPLICATION

This application is a continuation of application Ser. No. 180,325, filed Aug. 22, 1980, now abandoned.

TECHNICAL FIELD

The present invention relates generally to can making machinery of the type disclosed in U.S. Pat. No. 3,735,629. More specifically, the present invention relates to an improved cup feeding mechanism for a can making machine of the type disclosed in this patent.

BACKGROUND PRIOR ART

The above-mentioned patent discloses what is commonly referred to as a bodymaker for forming metal can bodies having an ironed side wall and a unitary inwardly domed end wall.

In the formation of such containers, it is customary to initially draw a flat circular metal disc into a cup shaped article in a cupping machine. The cups are then transferred to the bodymaker of the type disclosed in the above patent wherein the cup is initially redrawn to a reformed cup having a slightly smaller diameter and increased height. The reformed cup is then moved between a punch or ram and a plurality of ironing rings to reduce the side wall thickness of the cup. At the end of the stroke for the ram, the ram cooperates with a doming element to reform the end wall to an inwardly directed dome.

In the formation of containers utilizing a bodymaker of this type, it is absolutely essential to have the cup initially properly aligned with the ram and a cup holder sleeve that supports the cup during the initial redraw operation. Many proposals have been suggested for properly feeding the cups to the bodymaker of the above type and an example of one type of mechanism is disclosed in U.S. Pat. No. 3,715,905. In this patent, the patentee contemplates gravity feeding the cup to a horizontally reciprocating ram and positioning the cup with respect to the ram utilizing a generally U-shaped yoke that has adjustable alignment members associated therewith.

With increased speeds of operation of can making machinery of the above type, it has been difficult to rely upon gravity feeding alone for accurately aligning a cup with a ram on a bodymaker without having some of the cups tilted with respect to the ram thereby resulting in a jam.

More recently the manufacturer of bodymakers of the above type have incorporated another type of cup feeding mechanism wherein the cup is gravity fed along a vertical path laterally offset from the reciprocable ram which is reciprocated along a horizontal axis and a positive cup feeding mechanism is utilized for laterally shifting the cups from the path into alignment with the ram. In this system, the cups again are gravity fed along the path and a flat guide surface is located at the lower end of the path to receive the cups. The cups are then driven along the guide surface through a reciprocating drive member that forces the cups into engagement with a yoke surrounding the path of the ram. The cups are then picked up by the ram and a cup holder which holds the cup in accurate position during the redraw portion of the drawing and ironing operation.

Again such a system has found limited success but has created substantial problems when increased production is attempted. For example, a machine similar to the type disclosed in the above patent has recently been successfully operated at speeds of more than 200 cans per minute. At such speeds, as indicated above, it is totally impractical to rely upon gravity feeding of the cups into accurate alignment with the punch or ram.

When operating at such speeds, and utilizing the gravity feed laterally offset feeding mechanism described above, additional difficulties have been encountered in having the cup prematurely move towards the path for the ram and at times tilt with respect to the axis of the ram thereby resulting in a jam or misfeed.

One of the problems that has been encountered with the gravity feed laterally offset cup feeding mechanism discussed above, is the fact that the weight of the cups in the vertical path will have a tendency to move the lower most cup towards the ram prior to having the drive member or shuttle mechanism positively move such cup. If such movement should occur, the cup may become tilted with respect to its longitudinal axis resulting in a misfeed.

SUMMARY OF THE INVENTION

According to the present invention, the cup feeding mechanism of the above type has been improved so that the cup is positively held in a first position until such time as the cup is positively driven by the drive member towards the reciprocating ram. More specifically, the present invention is incorporated into a gravity feed system wherein the cup are gravity fed along a vertical path to a cup feeding mechanism. A stop member is located at the lower end of the vertical path to interrupt the cups and position the cups in alignment with a drive member that moves the cups horizontally from the path to the reciprocating punch. According to the present invention, the stop means includes a mechanism that defines a first or a stabilized position for the cups for pick-up by the reciprocating drive means so that the cups are accurately positioned before they are moved towards the path for the ram or, more specifically, towards the final cup position in the cup locator.

In the specific embodiment illustrated, the stop means has a planar surface which has a recess therein and the recess defines the first or stabilized position for the cups with the drive means reciprocated horizontally and laterally of the path to feed the cups into alignment with the reciprocating punch. In the specific embodiment illustrated, the recess defines a well which receives the cups and the well has an arcuate portion aligned with the center of the vertical path which defines the first position for the cups. Also, the drive means is in the form of a shuttle member that is reciprocated transversly of the path and has an arcuate surface on the outer free end thereof which corresponds substantially to the perimeter of the cup. Also, the shuttle member has a height which is substantially less than the diameter of the cup to substantially eliminate the possibility of the cup being tilted during movement.

BRIEF DESCRIPTION OF SEVERAL VIEWS OF DRAWINGS

FIG. 1 of the drawings discloses a side elevation view of the cup feeding mechanism constructed in accordance with the present invention;

FIG. 2 is a cross-sectional view as viewed generally along line 2—2 of FIG. 1; and FIG. 3 is a fragmentary cross-sectional view as viewed along line 3—3 of FIG. 1.

DETAILED DESCRIPTION

Figure 1:
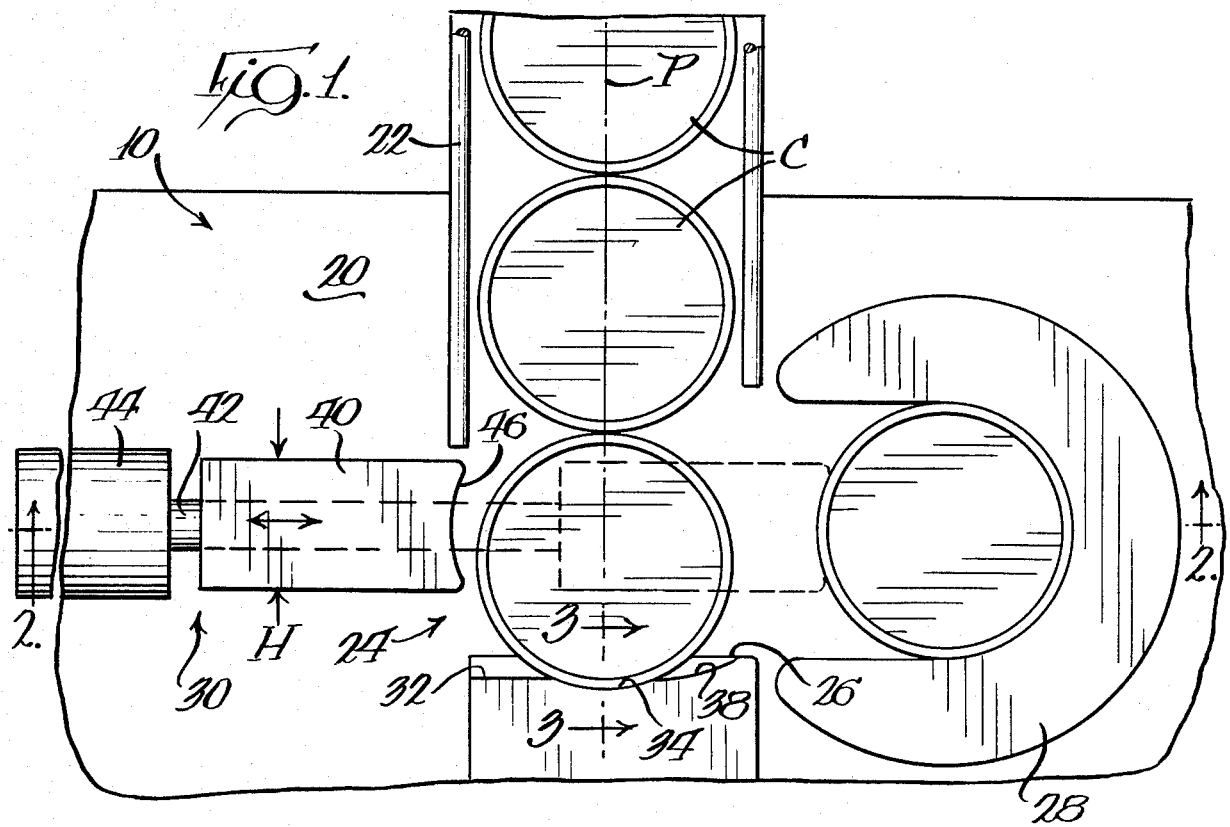

While this invention is susceptible of embodiment in many different forms, there is shown in the drawing and will herein be described in detail a preferred embodiment of the invention with the understanding that the present disclosure to be considered as an exemplification of the principle of the invention and is not intended to limit the invention to the embodiment illustrated.

FIG. 1 of the drawings generally discloses a cup feeding mechanism, generally designated by reference numeral 10. Cup feeding mechanism is adapted to feed cups C from an endless supply into alignment with a punch or ram 12 (FIG. 2) and a cup holder 14. The cup holder may be of the type disclosed in U.S. Pat. No. 4,193,279, assigned to the assignee of the present invention and incorporated herein by reference.

Cup feeding mechanism 10 is specifically adapted for feeding cups to a ram 12 associated with a bodymaker of the type disclosed in U.S. Pat. No. 3,735,629, incorporated herein by reference. In that patent, ram 12 is reciprocated along a generally horizontal path and picks up cups at the inlet end of a toolpack. The cup is then redrawn in a redraw ring cooperating with the ram and the side wall of the cup is reduced in thickness by the ram in cooperation with a plurality of ironing rings.

At the end of the stroke for the ram, the domed end of the ram cooperates with a domer assembly that reforms the end wall of the finished container and the finished container is stripped from the ram utilizing a stripper assembly at the end of the toolpack assembly.

The cup feeding mechanism of the present invention includes a frame generally designated by reference numeral 20 which may be part of the frame of the bodymaker. The frame has a generally vertically extending guide chute 22 which defines a generally vertical path P for the centers of a plurality of cups C that are gravity fed with the axes extending perpendicular to said path. The movement of the cups is interrupted in a transfer station, generally designated by reference numeral 24, by a stop surface 26 disposed in the path. The cups C are then moved into alignment with ram 12 against a yoke generally designated by reference numeral 28 by a reciprocating drive member 30. Yoke 28 has a generally arcuate opening, the base of which has a diameter substantially equal to the diameter of the cups being fed. The cup holder sleeve 14 and the ram 12 are inserted into the cup and the cup is forced through the remainder of the toolpack.

As indicated above, one of the problems that was previously encountered with a feed mechanism of this type is the fact that the generally planar flat surface 26 did not define a fixed position for the cup prior to being positively driven into transverse alignment with the ram. For example, if the cup were to be offset slightly from the center line of the path P, the cup would have a tendency to be forced towards the yoke 28 prior to being positively driven by the drive member. As a result, the offset of the lower most cup with respect to path P would have a tendency of the remainder of the cups to force the lower most cup towards the yoke 28. During such movement, it was possible to have the cup axis tilted somewhat with respect to the axis of the ram resulting in a jam or misfeed.

Another problem that has been encountered is that when a cup tends to move towards the yoke 28 prematurely, there is a possibility for a second cup entering the transfer area prior to the first cup being positively moved resulting in two cups being simultaneously fed to the path for the ram which results in a jam and can produce damage to the tooling.

According to the present invention, the cup feeding mechanism includes a means for defining a first fixed position for the cup at the lower most end of the path P to insure that the cup is positively controlled throughout its movement from the path P to the center line or axis of ram 12.

According to the present invention, the transfer area 24 has been redesigned to incorporate a positive stop and positioning means for each cup individually as it is gravity fed along the path P.

Figure 3:
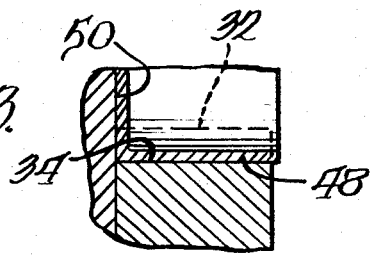

More specifically, as illustrated in FIGS. 1 and 3, the planar flat surface 26 in the transfer area 24 that defines a stop has a recess 32 extending from planar surface 26. Recess 32 has an arcuate portion 34 that 32 is generally aligned with the center of the path P and has a configuration of the corresponding substantially to the configuration of the periphery of the cup to define a cradle for the cup. Also, the recess or well 32 has an inclined ramp portion 38 which extends upwardly from recess 34 and merges with flat planar surface 26 at the upper end thereof.

Thus, the arcuate recessed portion 34 defines a first fixed position for cups C to maintain the cup centered along the center path P defined by the guide chute 22. The ramp portion guides the cup from the fixed position into alignment with the punch. The above arrangement insures that the cups do not move towards the yoke 28 prematurely and must be positively driven out of recess portion 34 along the inclined ramp 38 by the drive means 30.

Figure 2:
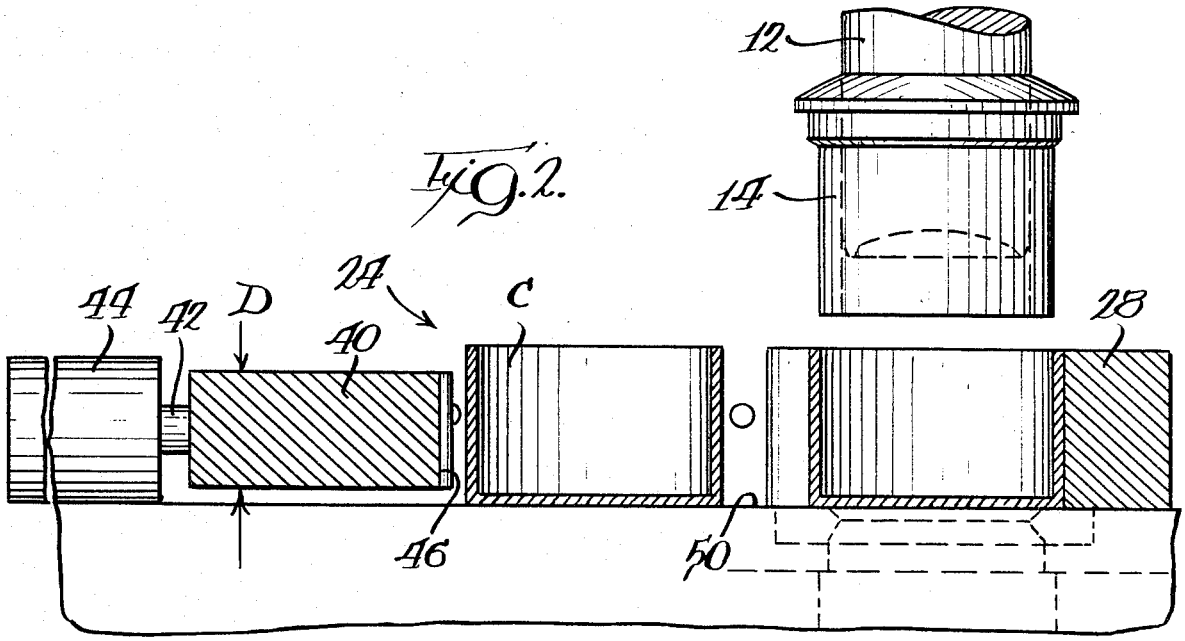

According to another aspect of the present invention, the drive means 30 is modified to more positively control the movement of the cup along the transverse path between the path P and the center line of ram 12. As illustrated in FIGS. 1 and 2, the drive means 30 includes a first member 40 that is supported on the piston rod 42 reciprocated in a cylinder 44. The outer free end of the member 40 has a generally arcuate surface 46 which conforms to the peripheral configuration of the cups C and the configuration of arcuate recess 34. Also, the height or vertical dimension H of member 40 is substantially less and preferably less than half the diameter of the particular cups, as well as the diameter of the opening in yoke 28 to limit the circumferential contact surface of the cup and prevent from any possible interference from the reciprocating member 40 and the next succeeding cup above the one being transferred. The reduction in the height of the member will allow the next succeeding cup to begin moving into the transfer area while the cup in the transfer area is moved toward the punch or ram.

Also as illustrated in FIG. 2, the depth or horizontal dimension D of member 40 is of such a dimension that is covers a substantial portion of the height of the sidewall 48 of cup C to insure that the cup is maintained in axial alignment with the axis for the punch during the transfer of the cup from the path P into alignment with ram 12. As shown in FIGS. 1 and 2, the horizontal diamension D is substantially equal to the vertical dimension H. By making the depth D cover a substantial portion of the axial dimension of the cup, extended surface engagement is produced between the arcuate surface 46 and the periphery of cup C so that the cup is positively driven along guide surface 50 located in the transfer area 24. The extended surface engagement also establishes substantial frictional forces which will inhibit axial movement of the cup as it is being positively driven along guide surface 50.

As can be appreciated from the above description, by utilizing the positive fixed position for the cups in the transfer area, the possibility of the cup tilting or the possibility of having two cups fed simultaneously is virtually eliminated since a positive force must be applied to the cups to move them from the center of the path P into the bodymaker area.

It should be noted that numerous modifications come to mind without departing from the spirit of the invention. For example, the guide chute need not necessarily extend vertically but could be offset or even be horizontal. Also, the criticality of the configuration of the drive member only applies to the end portion that comes in contact with the cup and the portion that is moved into the transfer area.

I claim:

1. A cup feeding machine for feeding cups to a drawing and ironing apparatus including a fixed frame having a reciprocal punch and a yoke having an arcuate opening having a diameter substantially equal to the diameter of the cup, said mechanism comprising a cup feeding means for supplying cups along a path to a stabilizing position, said stabilizing position being defined by a fixed planar surface having a cup receiving recess therein, said recess defining a stabilized position for said cups at the end of said path and having an inclined ramp portion merging with said fixed planar surface for guiding said cups to said yoke, and transfer means adapted to engage said cups while in said stabilizing position and move said cups from said stabilizing position along said inclined ramp portion into a final cup position in said yoke prior to drawing and ironing.

2. A cup feeding mechanism as defined in claim 1, in which cups are supplied along a path and said recess has an arcuate portion aligned with the center of said path.

3. A cup feeding mechanism as defined in claim 2, in which said transfer means includes a shuttle member reciprocable transversely of said path, said shuttle member having an arcuate surface conforming generally in configuration to said arcuate portion and adapted to engage said cups to move said cups from said stabilized position into said final cup position.

4. A cup feeding mechanism as defined in claim 3, in which said shuttle member has a height substantially less than the diameter of said opening in said yoke.

5. A cup feeding mechanism as defined in claim 4, wherein said height of said shuttle member is less than one-half of said diameter of said opening in said yoke.

6. A cup feeding mechanism as defined in claim 4 wherein said shuttle member has a depth generally equal to the height of the shuttle member.

7. A cup feeding mechanism for a can forming machine comprising a generally horizontal path for a plurality of cups, said path extending from a supply of cups above said path to a final cup transfer means at the end portion of said path for moving said cups the final distance in said path to a yoke having an arcuate opening having a diameter equal to the diameter of the cup, said stabilized cup transfer means includes a shuttle having (a) a forward arcuate surface adapted to provide substantial contact with a portion of the side wall of each cup being moved the final distance; (b) a top surface which supports the next cup as one cup is being moved by the shuttle to the final cup position; (c) a height relative to the diameter of the yoke opening substantially less than said yoke opening; and, (d) a substantial depth relative to the yoke depth.

8. A cup feeding mechanism for a can forming machine as defined in claim 7, wherein said stabilized cup transfer means further includes a recess in which each cup rests prior to being moved by said shuttle into said final cup position.

9. A cup feeding mechanism for a can forming machine as defined in claim 7 wherein said depth of said shuttle is generally equal to the depth of said yoke.

10. A cup feeding mechanism for a can forming machine as defined in claim 7, wherein said cup feeding mechanism operates at a speed of greater than 200 cups per minute.

* * * * *